United States Patent [19]

Siegl et al.

[11] Patent Number: 4,917,729

[45] Date of Patent: Apr. 17, 1990

[54] CORROSION INHIBITING AQUEOUS, ACIDIC COMPOSITIONS COMPRISING METAL-CHELATING O-HYDROXYBENZYLAMINE COMPOUND

[75] Inventors: Walter O. Siegl, Dearborn; Mohinder S. Chattha, Livonia, both of Mich.

[73] Assignee: Ford Motor Company, Dearborn, Mich.

[21] Appl. No.: 247,227

[22] Filed: Sep. 21, 1988

Related U.S. Application Data

[62] Division of Ser. No. 5,181, Jan. 20, 1987, Pat. No. 4,792,355.

[51] Int. Cl.[4] ..... C04B 9/02

[52] U.S. Cl. ..... 106/14.15

[58] Field of Search ..... 564/300; 106/14.15

[56] References Cited

U.S. PATENT DOCUMENTS

| | | | |
|---|---|---|---|
| 2,114,122 | 4/1938 | Bruson | 564/337 |
| 2,234,036 | 3/1941 | Zitscher et al. | 8/666 |
| 2,363,134 | 11/1944 | McCleary | 252/42.7 |
| 3,219,700 | 11/1965 | O'Shea et al. | 564/300 |
| 3,219,701 | 11/1965 | O'Shea | 564/300 |
| 3,888,928 | 6/1975 | Willis et al. | 564/388 |
| 3,994,989 | 11/1976 | Kempter et al. | 525/490 |
| 4,001,155 | 1/1977 | Kempter et al. | 525/490 |
| 4,310,592 | 1/1982 | Schmitz | 488/457 X |
| 4,357,181 | 11/1982 | Frank et al. | 148/6.14 R |
| 4,433,015 | 2/1984 | Lindert | 427/388.4 |
| 4,444,942 | 4/1984 | Kempter et al. | 528/149 |
| 4,466,840 | 8/1984 | Frank | 148/6.14 R |
| 4,714,752 | 12/1987 | Sokalski | 528/153 |
| 4,770,727 | 9/1988 | Siegl | 148/6.14 R |
| 4,790,878 | 12/1988 | Siegl | 106/14.15 |
| 4,792,355 | 12/1988 | Siegl | 106/14.15 |
| 4,795,505 | 1/1989 | Siegl | 106/14.15 |
| 4,795,506 | 1/1989 | Sokalski | 106/14.15 |

FOREIGN PATENT DOCUMENTS 0591210 1/1960 Canada .

*Primary Examiner*—Theodore Morris

*Attorney, Agent, or Firm*—Lorraine S. Melotik; Roger L. May

[57] ABSTRACT

This invention relates to an aqueous, acidic composition useful to deposit a corrosion inhibiting and adhesion promoting coating on a metal substrate and a method for doing same. The composition has a pH of between about 2 and about 6 and comprises water-soluble or water-dispersible metal-chelating o-hydroxybenzylamine compound, wherein the amine moiety contains pendant ethanol or propanol moiety.

9 Claims, No Drawings

CORROSION INHIBITING AQUEOUS, ACIDIC COMPOSITIONS COMPRISING METAL-CHELATING O-HYDROXYBENZYLAMINE COMPOUND

This is a division of Ser. No. 005,081, filed 01/20/87, now U.S. Pat. No. 4,792,355.

TECHNICAL FIELD

This invention relates to an aqueous, acidic composition useful to deposit a corrosion inhibiting and adhesion promoting coating on a metal substrate and a method for doing same. More particularly, the composition has a pH of between about 2 and about 6 and comprises water-soluble or water-dispersible metal-chelating o-hydroxybenzylamine compounds, wherein the amine moiety contains pendant ethanol or propanol moiety.

BACKGROUND OF THE INVENTION

One means of minimizing the impact of corrosion on metal surfaces has been to coat the surface with paint. The paint acts as a barrier between the metal surface and the environment and thus helps to prevent or at least minimize corrosion of the metal surface. However, one problem associated with this solution is that paint does not always adhere properly to the metal surface. The result may be peeling, cracking, blistering, or flaking of the paint, thus rendering the substrate metal surface again subject to corrosion.

The need for applying protective coatings to metal surfaces for improved corrosion resistance and paint adhesion is well known in the metal finishing and other metal arts. One attempt to alleviate the problem of poor adhesion of paint to metal surfaces has been to subject the metal substrate to a treatment which is known as phosphating, i.e. a process by which the metal surfaces are treated with chemicals which form a metal phosphate conversion coating on the metal surface. Such treatment typically assists in rendering the metal surface less subject to corrosive attack and, at the same time, in rendering the surface more suitable for application of paint. The resulting bond between the metal surface and the paint is thus greatly improved. However, phosphate baths require that precise formulations be maintained and that the processing procedures and conditions of operation be controlled within narrow limits. The phosphating process also requires that the metal surface be given two rinses subsequent to the phosphating bath, the first being a water rinse and the second being a passivating solution rinse which further enhances the corrosion resistance and adhesion characteristics of the coating. Traditionally, conversion coated metal surfaces have been given a second rinse with a solution containing a hexavalent chromium compound.

Lindert, in U.S. Pat. No. 4,433,015, teaches that, because of the toxic nature of hexavalent chromium compounds, expensive treatment equipment must be used to remove chromates from water effluent to prevent the pollution of rivers, streams and drinking water sources. Hence, in recent years there have been research and development efforts directed to discovering effective alternatives to the use of such post-treatment solutions. Lindert teaches that an alternative to the hexavalent chromium compound is a polymer having phenol groups attached along an ethylenic polymer backbone. The phenol groups may have a amine substituent which may further comprise hydroxy-alkyl groups. The polymer, made water soluble through neutralization of the amine moiety with organic acid, may be employed in an acidic or basic solution. It is also taught by Lindert that this solution, in addition to being used as a post-phosphate rinse, may be used to treat previously untreated metal surfaces including aluminum and zinc.

Frank et al, in U.S. Pat. No. 4,466,840, teach that there exists a need for a simple means to achieve results similar to that obtained with the phosphating process without the complexity of such a treatment. As an alternative to such phosphating treatment, Frank et al propose employing hydroxybenzylamines, preferably in aqueous solution, to produce coatings on metal surfaces, which coatings act as corrosion inhibitors and adhesion promotors. The amine moiety of these hydroxybenzylamines comprises secondary amine having alkyl substituents.

Embodiments of the o-hydroxybenzylamine of the present invention aqueous, acidic composition have been described in U.S. Pat. Nos. 2,114,122, 2,234,036, 2,363,134, 3,219,700 and 3,219,701. U.S. Pat. No. 2,114,122 to Bruson teaches a variety of phenolic aralkylamino alcohols for numerous diverse uses, including preparation of soaps, wetting or emulsifying agents, antioxidants in oils and rubber, pickling inhibitors, insecticides, metal-cleaning compositions, and in dyeing, tanning or mordanting operations. U.S. Pat. No. 2,234,036 to Zitscher et al is directed to a method for preparing hydroxybenzylamines and a process for dyeing materials by means of such compounds. U.S. Pat. No. 2,363,134 to McCleary is directed to use of various benzylamine compounds in mineral, lubricating oils so as to provide detergent, antioxidant or anti-corrosion stabilizing and load-carrying properties. U.S. Pat. No. 3,219,700 to O'Shea et al and U.S. Pat. No. 3,219,701 to O'Shea are directed to methods of preparing hydroxybenzyl amines useful as lubricating oil additives.

Neither of the above references to Lindert nor Frank et al teaches the metal-chelating compound of the present invention aqueous, acidic composition. Still further, while references have been discussed above which teach embodiments of the o-hydroxybenzylamine compound employed in the composition of the present invention, none of these references suggests employing those compounds in an aqueous, acidic composition useful to deposit an adhesion promoting and corrosion inhibiting coating on metal surfaces as in this invention.

DISCLOSURE OF THE INVENTION

The present invention is directed to an aqueous, acidic composition useful to deposit a corrosion inhibiting and adhesion promoting coating on a metal substrate. The composition has a-pH of between about 2 and about 6 and comprises at least about 0.01 weight percent, preferably between about 0.1 and about 2 weight percent, of water-soluble or water-dispersible o-hydroxybenzylamine metal-chelating compound selected from compounds having the general chemical formula:

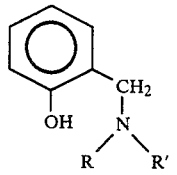

wherein R is an alkanol moiety selected from ethanol and propanol moieties and R is H, alkyl, aryl or hydroxy alkyl. Preferably, the pH of the composition is between about 2.5 and about 4.5 most preferably the pH of the composition is about 3.

This invention is also directed to a method for depositing an adhesion promoting and corrosion inhibiting coating on a corrodible metal substrate, which method comprises contacting the substrate with the above described composition for a time sufficient to deposit a coating comprising water-insoluble o-hydroxybenzylamine metal-chelate compounds thereon.

In an acidic solution, metal ions are liberated from the surface of a metal substrate. When a metal substrate is contacted with the aqueous, acidic composition of the present invention, metal ions, e.g. $Fe^{+3}$, are liberated from the substrate surface and form a complex with metal-chelating compound present in the composition. It is believed that the compound's ability to chelate metal ions is based on the fact that the hydroxyl group on the benzene ring is ortho in position to the amine moiety and that the amine moiety contains a hydroxyl group 2 or 3 Carbons removed from the nitrogen (i.e. on the pendant ethanol, propanol, or such substituted moiety). In particular, these two hydroxyl groups and the nitrogen in this defined arrangement chelate with the metal ion. While the metal-chelating compound is water-soluble or water-dispersible, the metal-chelate compound formed is, on the other hand, insoluble in the aqueous, acidic composition and precipitates onto the substrate to form a coating. While the above theory is advanced to explain the ability of the metal-chelating compounds of the composition to form a coating, neither its accuracy nor its understanding is necessary for operation of the present invention.

Advantageously, the present invention composition overcomes the deficiencies of prior art compositions as discussed above and provides a simple method for depositing a coating on a metal substrate for inhibiting corrosion of the metal substrate and for improving adhesion of paint thereto. Advantageously, the adhesion promoting ability of the present invention coating is also effective when employed with organic adhesives.

DETAILED DESCRIPTION OF THE INVENTION

The composition of the present invention comprises at least about 0.01 weight percent of a water-soluble or water-dispersible o-hydroxybenzylamine metal-chelating compound, preferably the composition comprises this compound in an amount between about 0.1 and about 2 weight percent. While amounts greater than this preferred amount may be employed in the composition, it does not appear that the corrosion protection provided by the resultant coating is further substantially enhanced. Thus, it does not appear commercially advantageous to employ such greater amounts. However, under some circumstances, for example for transporting or storing the solution, the concentrate of the composition may be preferred. Thus, compositions generally comprising up to about 30 percent of the treatment compound may be provided. From a commercial point of view, a suitable concentrate of this invention comprises from about 5 percent to about 30 percent of the treatment compound.

The water soluble or water dispersible metal-chelating compound of the present invention aqueous, acidic composition is selected from compounds having the general chemical formula:

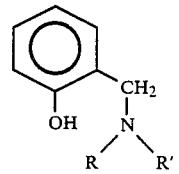

wherein R is an alkanol moiety selected from ethanol and propanol moieties and R′ is H, alkyl, aryl or hydroxy alkyl. Preferably R′ is alkyl or hydroxy alkyl. The phenol ring and the alkanol moiety may be substituted with non-interfering functionality, i.e. functionality that would not substantially interfere with the intended use of these compounds as described in this invention. Exemplary functionality which may be present on the phenol ring and alkanol moiety is alkyl, alkoxy, aryl and halogen. Preferably, the phenol ring and alkanol moiety are unsubstituted or substituted with alkyl or aryl groups and more preferably, when substituted, are substituted with alkyl groups of 1 to 4 carbons. As would be understood by one skilled in the art in view of the present disclosure, it is intended that such groups may be of any carbon chain length at which the compound is water-soluble or water-dispersible with the aid of acids. Preferably, such compound has a molecular weight of up to about 700. As would be apparent to one skilled in the art in view of the present disclosure, compatible mixtures of such compounds may also be used in the composition of the present invention.

These compounds may be prepared by conventional techniques known to those skilled in the art and described in various publications. U.S. Pat. Nos. 2,114,122, 2,234,036, 2,363,134, 3,219,700 and 3,219,701, discussed above, are hereby incorporated by reference for their teachings of methods for the preparation of such compounds. One such method involves reacting 1 mole equivalent of a phenol having at least 1 unsubstituted ortho-position (e.g., bisphenol-A), 1 mole equivalent of a suitable hydroxy funCtional amine (e.g., 2-(methylamino)ethanol) with 1 mole equivalent of formaldehyde for a time sufficient to form the o-hydroxybenzylamine.

The treatment composition of the present invention is an aqueous, acidic solution composition having a pH of between about 2 and about 6, preferably between about 2.5 and 4.5 and most preferably about 3. Organic or inorganic acids may be employed to provide the required acidic character (pH) to the composition. These acids may also aid in solubilizing or dispersing the compound, should such be necessary. Preferably, acids so employed are acids of strongly coordinating anions such as phosphoric acid, sulfuric acid, hydrochloric acid, oxalic acid and acetic acid, acids of weakly coordinating ions, e.g., $ClO^{-4}$, being less effective. Mixtures of compatible acids may also be employed.

Optional materials which may be included in the composition of this invention include those materials commonly employed in corrosion inhibiting and adhesion promoting coating formulations. Exemplary of such materials are dispersing agents, pigments, adhesion promoters and solubilizers such as polyacrylic acid, polyamines, and polyphenols (e.g., novolaks) and compatible corrosion inhibitors. The aqueous composition of this invention may also comprise an alcohol as a co-solvent (i.e. in addition to the water), which alcohol has been found useful to produce a clear solution. Exemplary of such alcohols which may be so employed include, but are not limited to, methanol, ethanol, isopropanol, and propasol-P (trademark, Union Carbide Corp.).

As in a typical metal treatment operation, the metal to be treated with the aqueous, acidic composition of the present invention is initially cleaned by a chemical and/or physical process and water rinsed to remove grease and dirt from the surface. The metal surface is then brought into contact with the treatment solution of this invention. The present invention is useful to coat a broad range of metal surfaces, including zinc, iron, aluminum, tin, copper and their alloys, including cold-rolled, ground, pickled, and hot rolled steel. The metal surface may be in any physical form, such as sheets, tubes, or rolls.

The corrosion inhibiting adhesion promoting composition of the present invention may be applied to metal surfaces in any convenient manner. Thus, it may be sprayed, painted, dipped or otherwise applied to the metal surface. The temperature of the applied solution can vary over a wide range, from the solidification temperature of the solution or dispersion to the boiling point of the solution or dispersion. During application to the metal surface, the temperature of the composition of this invention is preferably maintained between about 20° C. and 80° C., more preferably between about 20° C. and 55° C. It is generally believed that a substantially uniform layer of the corrosion inhibitor/adhesion promoter coating should be deposited on the metal surface. It is also believed that something approaching a molecular layer is sufficient to achieve the desired results. Useful contact time has been found to be about 0.25 to about 5 minutes, with contact times between about 0.25 and 1 minute being sufficient at about room temperature. As will be apparent to those in the art in view of the present disclosure, treatment time and temperature of the applied composition may vary from those described. Selection of optimal composition and method parameters, such as concentration of the metal-chelating o-hydroxybenzylamine compound, pH, optional materials, contact time, and bath temperature during coating, would be dependent, in part, on the particular substrate, processing conditions and final coating desired. As such, selection of such parameters will be within the skill of those in the art in view of the present disclosure.

After application of the treatment composition to the metal surface, the surface is preferably rinsed, although good results can be obtained without rinsing after treatment. For some end uses, for example, in electrocoat paint application, rinsing may be preferred. Next, the treated metal surface is dried. Drying can be carried out by, for example, circulating air or oven drying. While room temperature drying can be employed, it is preferable to use elevated temperatures to decrease the amount of drying time required. After drying, the treated metal surface is ready for painting or the like. The surface is suitable for standard paint or other coating application techniques such as brush painting, spray painting, electro-static coating, dipping, roller coating, as well as electrocoating. As a result of the treatment step of the present invention, the metal-chelate compound coated surface has improved paint adhesion and corrosion resistance characteristics. Additionally, this coated surface acts to improve the adhesion when conventional adhesive materials are used to affix one such coated surface to another.

The invention will be further understood by referring to the following detailed examples. It should be understood that the specific examples are presented by way of illustration and not by way of limitation. Unless otherwise specified, all references to "parts" is intended to mean parts by weight.

EXAMPLE 1

To 37.6 g of bisphenol-A in 100 ml of 95% ethanol was added 25 g of 2-(methylamino)ethanol and 50 ml of water. The solution was stirred and heated to 40–50° C. Then 27 g of 37% formaldehyde solution was added over a 40 minute period, while stirring was continued. The mixture was heated 5 hours at 40–45° C. The ethanol was then removed under reduced pressure. Aqueous HC1was added to the residue until a pH of about 1 was achieved. An extraction with methylene chloride was carried out to remove unreacted phenol. The pH was then adjusted to neutral with NaOH and the aqueous mixture was extracted with methylene chloride. The extract was passed through a column of silica gel and concentrated to afford a pale yellow oil; thin layer chromatography ($SiO_2/CH_2C1_2$) analysis indicated that the oil was pure. The ir and nmr spectra were recorded and were in agreement with the expected chemical structure of a metal-chelating o-hydroxybenzylamine compound according to the present invention composition.

A 0.25% (weight) solution of the o-hydroxybenzylamine product prepared above was made by dissolving 1.25 g of this product in 500 ml of an ethanol/water mixture (1:4 by volume). The pH of the solution was adjusted to 3 with $H_2SO_4$. Cold rolled steel panels (Parker Chemical Co., Detroit, Mich.) were rinsed with toluene and acetone to remove shipping oils and then dipped in the above solution for 1 minute at ambient temperature (23° C). The panels were rinsed with deionized water, allowed to drain, and then dried for 10 minutes at 110° C. Two coats of a tall oil modified bisphenol A-epichlorohydrin epoxy resin/crosslinked with alkylated melamine primer were applied and the panels were then baked for 20 minutes at 150° C. The panels had a cured paint thickness of 28–33μm.

These panels were scribed and subjected to salt spray testing (ASTM B-117). The painted panels treated with the solution comprising the o-hydroxybenzylamine prepared above failed only after 6 days of salt spray exposure whereas similarly painted panels, prepared as above except that only deionized water was used in place of the above prepared solution, failed in 2–3 days. (Failure is considered 4 mm of paint loss (undercutting) on either side of the scribe line.)

EXAMPLE 2

An o-hydroxybenzylamine metal-chelating compound of the present invention composition was prepared according to the procedure of Example 1, except that 40.3 g of 4-ethylphenol was used in place of the Bisphenol-A and that heating of the reactants was only begun after the formaldehyde addition was completed. A 0.1% (weight) solution of the o-hydroxybenzylamine product was prepared by dissolving 0.5 g of the product in 500 ml of ethanol/water (1:4 by volume). The pH of the solution was adjusted to 3 with phosphoric acid.

Cold-rolled steel panels (Parker Chemical Co.) were rinsed with toluene and with acetone, treated with the metal-chelating solution of this example, and rinsed according to the procedure of Example 1. The treated panels were then spray painted with primer and cured as in Example 1. Subsequently, the panels were scribed and salt spray tested (ASTM B-117). The panels so treated did not fail until after 6 days of salt spray exposure.

EXAMPLE 3

An o-hydroxybenzylamine metal-chelating compound of the present invention composition was prepared according to the procedure of Example 1, except that 50g of 4-t-butylphenol was employed in place of the Bisphenol-A and that heating of the reactants was only begun after the formaldehyde addition was completed. 0.5 g of the product was dissolved in 500 ml of ethanol/water (1:4 by volume) and the pH was adjusted to 3.0 with phosphoric acid to form a 0.1% (weight) solution of the o-hydroxybenzylamine compound.

Cold-rolled steel panels (Parker Chemical Co.) were rinsed with toluene and with acetone, treated with the metal-chelating solution of this example, and rinsed according to the procedure of Example 1. The treated panels were then spray painted with primer and cured as in Example 1. Subsequently, the panels were scribed and salt spray tested (ASTM B-117). The panels so treated did not fail until after exposure to salt spray for 6 days.

EXAMPLE 4

An o-hydroxybenzylamine compound of the present invention composition was prepared according to the procedure of Example 1, except that 40.3 g of 2,4-dimethylphenol was used in place of Bisphenol-A and that heating of the reactants was only begun after the formaldehyde addition was completed. 0.50 g of the product was dissolved in 500 ml of ethanol/water (1:4 by volume) and the pH was adjusted to 3.0 with phosphoric acid to form 0.1% (weight) solution of the o-hydroxybenzylamine compound.

Cold-rolled steel panels (Parker Chemical Co.) were rinsed with toluene and with acetone, treated with the metal-chelating solution of this example, and rinsed according to the procedure of Example 1. The treated panels were then spray painted with primer and cured as in Example 1. Subsequently, the panels were scribed and salt spray tested (ASTM B-117). The panels so treated did not fail until after exposure to salt spray for 6 days.

EXAMPLE 5

1.25 g of the metal-chelating product from Example 2 was dissolved in 500 ml of ethanol/water (1:4 by volume) and the pH was adjusted to 3.0 with hydrochloric acid to form a 0.25% (weight) solution of the o-hydroxybenzylamine compound.

Cold-rolled steel panels (Parker Chemical Co.) were rinsed with toluene and with acetone, treated with the metal-chelating solution of this example, and rinsed according to the procedure of Example 1. The treated panels were then spray painted with primer and cured as in Example 1. Subsequently, the panels were scribed and salt spray tested (ASTM B-117). The panels so treated did not fail until after salt spray exposure for 6 days.

EXAMPLE 6

0.50 g of the metal-chelating product from Example 2 was dissolved in 500 ml of ethanol/water (1:4 by volume) and the pH of the solution was adjusted to 3.0 with sulfuric acid.

Cold rolled steel panels (Parker Chemical Co.) were toluene/acetone rinsed, dipped for 15 seconds in the solution of this example, rinsed with deionized water, dried, spray painted and baked as described in Example 1. These panels were scribed and subjected to salt spray testing (ASTM-B-117). They failed only after 6 days of salt spray testing.

EXAMPLE 7

0.5 g of the metal-chelating product from Example 2 was dissolved in 500 ml of ethanol/water (1:4 by volume) and the pH of the solution was adjusted to 4.0 with phosphoric acid.

Cold-rolled steel panels (Parker Chemical Co.) were toluene/acetone rinsed, dipped for 1 minute in the solution of this example, rinsed with deionized water, dried, spray painted, and cured as described in Example 1. These panels were scribed and subjected to salt spray testing (ASTM-B-117). The panels so treated did not fail until after 6 days of salt spray testing.

EXAMPLE 8

0 5 g of the metal-chelating product from Example 2 is dissolved in 500 ml of isopropanol/water (1:4 by volume) and the pH of the solution is adjusted to 2.5 with phosphoric acid.

Cold-rolled steel panels rinsed (Parker Chemical Co.) are toluene/acetone rinsed, dipped for 1 minute in the solution of this example, rinsed with deionized water, dried, spray painted, and cured as described in Example 1. These panels are scribed and subjected to salt spray testing (ASTM-B-117). The panels so treated did not fail until after 6 days of salt spray testing.

EXAMPLE 9

An o-hydroxybenzylamine compound of the present invention composition is prepared according to the procedure of Example 1, except that 50 g of 4-t-butylphenol is employed in place of the Bisphenol-A, 25 g of 3-aminopropanol is employed in place of the 2-(methylamino)ethanol and that heating of the reactants was only begun after the formaldehyde addition was completed. A 0.5 g sample of the product is dissolved in 500 ml of ethanol/water (1:4 by volume) and the pH of the solution is adjusted to 3.0 with phosphoric acid.

Cold-rolled steel panels rinsed (Parker Chemical Co.) are toluene/acetone rinsed, dipped for 1 minute in the solution of this example, rinsed with deionized water, dried, spray painted and cured as described in Example 1. These panels are scribed and subjected to salt spray testing ASTM-B-117. The panels so treated did not fail until after 6 days of salt spray testing.

EXAMPLE 10

An o-hydroxybenzylamine compound of the present invention composition was prepared according to the procedure of Example 1, except that 50 g of 4-t-butylphenol was employed in place of the Bisphenol-A, 20.1 g of ethanolamine was employed in place of the 2-(methylamino)ethanol, and that heating of the reactants was only begun after the formaldehyde addition was completed. A 0.5 g sample of the product was dissolved in 500 ml of ethanol/water (1:4 by volume) and the pH of the solution was adjusted to 3.0 with phosphoric acid.

Cold-rolled steel panels (Parker Chemical Co.) were toluene/acetone rinsed, dipped for 1 minute in the solution of this example, rinsed with deionized water, dried, spray painted and cured as described in Example 1. These panels were scribed and subjected to salt spray testing (ASTM-B-117). The panels so treated did not fail until after 6 days of salt spray testing.

EXAMPLE 11

Two cold rolled steel coupons are rinsed with toluene and with acetone and treated with the metal chelating solution of Example 2. The treated coupons are bonded with a 2-component epoxy adhesive (Quantum Composites Co.) to form a single overlap joint. The bond strength is tested on an Instron Mechanical Test Apparatus. A greater than 50% increase in bond strength is observed for coupons so treated as compared to coupons bonded with the adhesive but not first treated with the metal chelating solution. After 2 weeks of humidity exposure (40° C., 95% relative humidity) the relative increase in bond strength is even greater.

In view of this disclosure, many modifications of this invention will be apparent to those skilled in the art. It is intended that all such modifications which fall within the true scope of this invention be included within the terms of the appended claims.

We claim:

1. An aqueous, acidic composition useful to deposit a corrosion inhibiting coating on a metal substrate, said composition (1) having a pH of between about 2 and about 4.5 and (2) consisting essentially of at least about 0.01 weight percent of a water-soluble or water-dispersible metal-chelating compound selected from compounds having the general chemical formula:

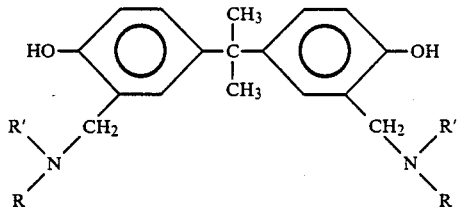

wherein R is selected from hydroxy ethyl and hydroxy propyl moieties which may be substituted with non-interfering functionality and R' is H, alkyl, aryl or hydroxy alkyl.

2. The aqueous, acidic composition according to claim 1, wherein said pH of said composition is between about 2.5 and about 4.5 .

3. The aqueous, acidic composition according to claim 2, wherein said pH of said composition is about 3.

4. The aqueous, acidic composition according to claim 1, wherein said composition comprises between about 0.1 and about 2 weight percent of said metal-chelating compound.

5. The aqueous, acidic composition according to claim 1, wherein said metal-chelating compound has a molecular weight up to about 700.

6. The aqueous, acidic composition according to claim 1, wherein R' is alkyl or hydroxy alkyl.

7. The aqueous, acidic composition according to claim 1, wherein said composition further comprises alcohol.

8. The aqueous, acidic composition according to claim 1, wherein the temperature of said composition is between about 20° and about 55° C.

9. The aqueous, acidic composition according to claim 1, wherein the composition is made acidic by means of acid selected from phosphoric acid, sulfuric acid, hydrochloric acid, acetic acid, oxalic acid and a compatible mixture of any of them.

* * * * *